United States Patent [19]

Spatz

[11] 3,991,775

[45] Nov. 16, 1976

[54] COSMETIC APPLICATOR

[75] Inventor: Walter B. Spatz, Pacific Palisades, Calif.

[73] Assignee: Spatz Corporation, Venice, Calif.

[22] Filed: Feb. 24, 1975

[21] Appl. No.: 552,044

[52] U.S. Cl. ..... 132/79 C
[51] Int. Cl.[2] ..... A45D 40/00
[58] Field of Search ..... 132/79 C, 88.7, 88.5; 401/78, 75, 68; 206/56

[56] References Cited

UNITED STATES PATENTS

| | | | |
|---|---|---|---|
| 1,849,531 | 3/1932 | Lyhne | 401/78 |
| 1,953,910 | 4/1934 | Parkin | 132/79 C |
| 2,345,315 | 3/1944 | Anderson | 401/78 |
| 2,393,677 | 1/1946 | Gelardin | 206/56 |

*Primary Examiner*—G.E. McNeill
*Attorney, Agent, or Firm*—Subkow & Kriegel

[57] ABSTRACT

A cosmetic applicator, such as a lipstick applicator, includes an inner cosmetic holder or cup in which a cosmetic mass or lipstick is securable, and which is disposed within a carrier sleeve fixed to a base and surrounded by a tubular member having an internal helical groove or thread receiving one or more cup keys extending through longitudinal slots in the sleeve into the helical groove, or meshing with the internal helical thread, so that relative turning between the tubular member and the carrier and base effects advancing and retracting movements of the cup and cosmetic mass along the carrier sleeve. The carrier sleeve has an unslotted forward extension on which an enclosing cap can be mounted which has substantially the same external diameter as the tubular member and base, resulting in an applicator of greater slimness than prior applicators, better appearance and requiring less material.

11 Claims, 4 Drawing Figures

COSMETIC APPLICATOR

The present invention relates to cosmetic applicators, and more particularly to applicators for applying lipstick to a person's lips, or some other cosmetic mass to portions of a person.

Prior lipstick applicators include an outer tubular member having an internal helical groove, with a carrier sleeve disposed therein having two longitudinal slots opening through the forward end of the sleeve, the rearward portion of the sleeve terminating in a base. The tubular member and sleeve are substantially coterminous at ther forward ends. A cup, in which the lipstick is inserted, is disposed within the sleeve. This cup has a pair of lugs or keys extending through the longitudinal slots into the helical groove, relative turning between the tubular member and carrier sleeve effecting forward advancing of the cup, to project the lipstick beyond the forward end of the carrier sleeve, or retraction of the cup and lipstick within the carrier sleeve, depending upon the direction of relative turning. When the lipstick is not in use, the cup and lipstick are in retracted position. An elongate protective cap is placed over the entire length of the tubular member and frictionally over a forward portion of the base to enclose the tubular member and the carrier sleeve, and the lipstick therewithin, the cap projecting forwardly beyond the tubular member and carrier sleeve.

The prior applicators have four concentric members. The cap surrounds the tubular member, the tubular member surrounds the carrier sleeve, and the carrier sleeve surrounds the cup. These four members all contribute to the overall diameter of the applicator, which is the diameter of the cap, such cap diameter necessarily being greater than the diameter of the tubular member which it surrounds.

In the prior applicators, the carrier sleeve slots open through the forward end of the sleeve and are visible and unsightly. Moreover, because of its extended length, the cap may touch the cosmetic mass during its replacement over the tubular member, producing undesirable transfer of some of the mass to the rearward or open rim end of the cap, a condition which is messy and unsightly.

In cosmetic applicators embodying the present invention, the carrier sleeve has a forward extension which enables the cap to be mounted on it, the cap terminating at the forward end of the tubular member. More specifically, the greatest diameter of the applicator can be the outside diameter of the tubular member containing the helical groove or thread, since the outside diameter of the cap at the forward portion of the applicator and of the base at the rearward portion of the applicator need not be any greater than the outside diameter of the tubular member. As a result, there are three concentric members only contributing to the overall diameter of the applicator, namely, the cup, the carrier sleeve and the tubular member. This enables an applicator to be provided of greater slimness than prior devices, since the cap does not surround the tubular member and the forward portion of the base.

The longitudinal slots in the carrier sleeve terminate at the rear end of the forward extension, which enables the extension to be made circumferentially continuous; that is, unslotted. As a result, the slots are not visible, which enhances the appearance of the applicator when the cap is removed, as well as when the cap is in place, in the event the cap is made of transparent material.

The base is preferably made separate from the carrier sleeve and then suitably affixed thereto, which permits the sleeve slots to terminate or run out at the rear end of the sleeve, enabling the forward extension of the sleeve to be circumferentially continuous.

The mounting of the cap on the forward extension of the carrier sleeve enables the cap to be much shorter than in prior devices, which decreases the danger of the rim of the cap touching the cosmetic mass upon cap replacement on the carrier sleeve extension. In fact, when the cup is in its fully retracted position the forward end of the cosmetic mass or lipstick can be disposed fully within the circumferentially continuous extension of the carrier sleeve.

Applicators embodying the present invention have greater slimness, require less materials, and can offer new aesthietic designs.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the drawings.

Figure 1:
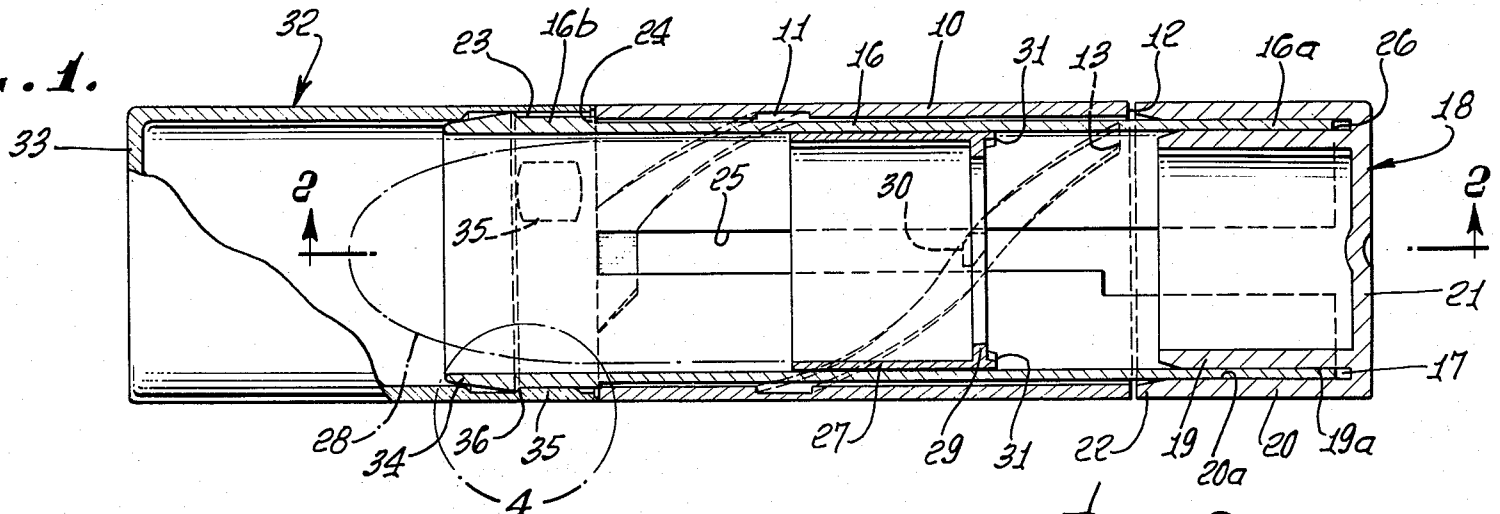
FIG. 1 is a longitudinal section, with a small portion of the cap disclosed in side elevation, through a cosmetic applicator embodying the invention.
Figure 2:
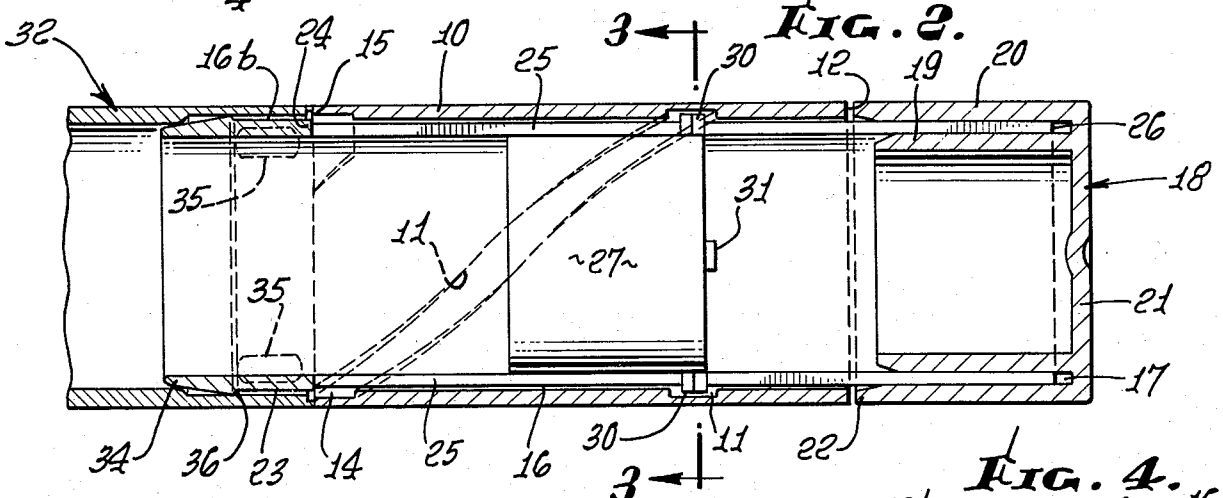
FIG. 2 is a longitudinal section taken along the line 2—2 on FIG. 1.
Figure 4:
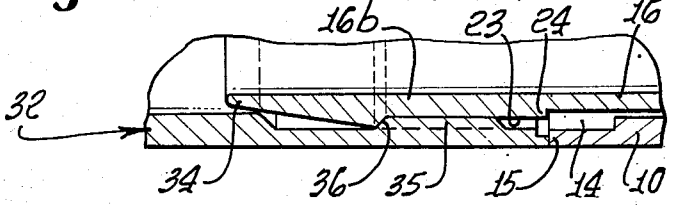
FIG. 4 is an enlarged fragmentary, longitudinal section of the region indicated by the circle 4 in FIG. 1.
Figure 3:
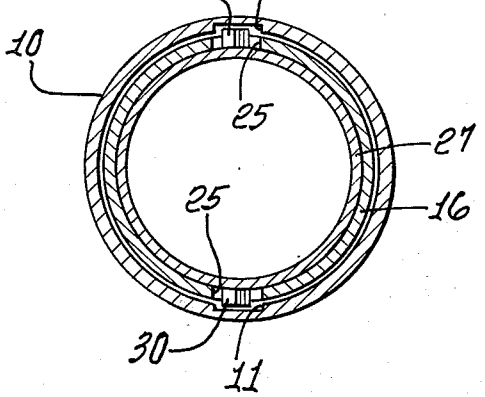
FIG. 3 is a cross-section taken along the line 3—3 on FIG. 2.

The cosmetic applicator includes an outer cylindrical tubular member 10 having an internal helical groove or thread 11 therein, such as a two-start thread or groove, the rear end of each thread or groove terminating short of the rear end 12 of the tubular member to provide a transverse stop 13. The forward end 14 of the thread or groove terminates or runs out at the forward end 15 of the tubular member.

Disposed within the tubular member is a cylindrical carrier sleeve 16 having a rear portion **16*a* extending beyond the rear end 12 of the tubular member and fitting within an annular groove 17 in a base portion 18 of the sleeve structure, the groove being defined between radially spaced inner and outer skirts 19, 20 extending forwardly from the end wall 21 of the base. The carrier sleeve 16 is initially separate from the base. When inserted in the groove 17, it makes a press fit against the confronting cylindrical surfaces 19*a*, 20*a* of the inner and outer skirts. The carrier sleeve may be secured to the base by welding it thereto, as through use of ultrasonic means. It is to be noted that the forward end 22 of the outer skirt terminates closely adjacent to the rear end 12 of the tubular member, the outer skirt preferably having substantially the same outside diameter as the diameter of the tubular member 10**.

The carrier sleeve 16 has a forward circumferentially continuous portion or extension **16*b* in advance of the end 14 of the helical thread or groove. The extension has a periphery 23 greater in diameter than the main portion of the carrier sleeve to provide a shoulder 24 extending partially across the forward end 15 of the tubular member, thereby preventing substantial forward axial movement of the tubular member 10 with respect to the carrier sleeve 16. Rearward longitudinal movement of the tubular member 10 on the carrier sleeve is prevented by engagement of the tubular member 10 with the forward end 22 of the outer skirt. Thus, the tubular member 10 is confined for relative turning or rotation with respect to the carrier sleeve 16 and its base 18.**

As specifically disclosed, the carrier sleeve 16 has a pair of diametrically opposed longitudinal slots 25 opening through at the rear end 26 of the sleeve and terminating at the sleeve shoulder 24. Disposed within the sleeve is a cup, socket or holder 27 adapted to have the rear portion of the cosmetic mass, such as lipstick 28, mounted therewithin which bears against an inwardly directed cup flange 29. Integral with the cup are a pair of diametrically opposed lugs or keys 30 extending through the slots 25 for reception within the two-start internal helical thread or groove 11 of the tubular member 10. It is to be noted that engagement of the keys with the opposed sides of the slots 25 prevents the cup or holder 27 from partaking of any significant turning relative to the carrier sleeve 16. Accordingly, relative turning between the tubular member 10, on the one hand, and of the carrier sleeve 16, sleeve base 18 and cup 27, on the other hand, will result in longitudinal feeding of the cup and the cosmetic mass 28 secured therein along the carrier sleeve 16. Such relative turning in one direction will result in retraction or rearward movement of the cup within the carrier sleeve to the extent limited by engagement of the lugs or keys 30 with the stops 13 provided at the rear end of the helical groove 11. Relative rotation in the opposite direction will shift the cup 27 and lipstick 28 in a forward direction to project the lipstick beyond the forward end of the carrier sleeve extension **16*b*, the forward movement of the cup and lipstick being limited by engagement of the lugs or keys 30** with the rear end of the the extension.

The cup has a pair of diametrically opposite fingers 31 extending rearwardly beyond its flange 29, which frictionally engage the inner wall or surface of the carrier sleeve 16 to resist, but not prevent, longitudinal movement of the cup 27 along the carrier sleeve. Such resistance to movement is overcome by imparting sufficient torque to the tubular member 10 and carrier to secure their relative turning and advancing or retracting of the cut 27 and lipstick 28 with respect to the carrier sleeve 16. The frictional engagement between the fingers 31 and the inner wall or surface of the carrier sleeve 16 prevents the cup 27 from moving inadvertently axially with respect to the carrier sleeve.

A cylindrical cap 32 having a forward end wall 33 is provided which is adapted to be slipped frictionally over the extension **16*b* and into abutting relation to the forward end 15 of the tubular member 10. for the purpose of enclosing the open end of the carrier sleeve extension and to protect the forward end of the lipstick. The circumferentially continuous extension preferably has a tapered forward portion 34 which serves to guide the rear, open end of the cylindrical cap onto the extension 16*b* and place it in a position coaxial with the other members of the cosmetic applicator. The cap, which is made of an elastic material, is held frictionally on the extension by circumferentially spaced cap tabs 35 frictionally engaging the periphery of the extension. The cap may be removed by exerting sufficient forward pull thereon, the tabs being released by their engagement with the tapered or cam surface 36 on the extension which expands the tabs outwardly, permitting the cap to be shifted forwardly off the extension 16*b*.**

The cylindrical cap 32, tubular member 10 and outer skirt 20 of the base have substantially the same external diameter. Since the cap extends over the carrier sleeve extension **16*b* only and terminates at the forward end 15 of the tubular member, it is not necessary to provide a cap of increased diameter for enclosing the tubular member 10. As a result, the applicator has a substantially smaller maximum diameter, producing its greater slimness. Since the cylindrical cap 32 is much shorter than prior cosmetic applicators of the type illustrated herein, there is a substantial savings in material. Moreover, the outside diameter of the base 18 is smaller than in prior devices, which also results in savings in material. The making of the base 18 separate from the carrier sleeve 16 enables the slots 25 to open through the rear end 26 of the carrier sleeve, permitting the forward extension portion 16*b* of the carrier to be circumferentially continuous. As a result, the slots 25 are not exposed to view, which enhances the appearance of the applicator upon removal of the cap. The shorter cylindrical cap of the present applicator also makes it less likely that its rearward rim portion will engage the cosmetic mass or lipstick 28, in the event the latter is not fully retracted within the carrier sleeve 16, thereby insuring the maintenance of the cylindrical cap in a clean condition. Because of the use of the relatively short cylindrical cap 32 and its termination at the forward end of the tubular member 10, three cylindrical applicator surfaces are visible, all preferably of the same outside diameter. These are the cylindrical peripheries of the cap 32, tubular member 10 and outer skirt 20** of the base. The result is a cosmetic applicator presenting a new aesthetic appearance.

I claim

1. A cosmetic applicator comprising an elongate outer tubular member having internal helical thread means, an elongate carrier sleeve structure within said member having a rear base portion extending rearwardly beyond said member and an extension portion extending forwardly beyond the forward end of said member, said sleeve structure having a longitudinal slot, a cosmetic holder slidable longitudinally within said sleeve structure and having key means extending through said slot into mesh with said helical thread means, whereby relative turning between said tubular member and sleeve structure shifts said holder forwardly and rearwardly in said sleeve structure, and a cap mounted on and releasably secured to said extension portion, the rear end of said cap terminating forwardly of the forward end of said tubular member.

2. A cosmetic applicator as defined in claim 1; said extension portion and base portion providing stop means engageable with the forward and rearward ends, respectively, of said tubular member to prevent substantial relative longitudinal movement between said carrier sleeve structure and tubular member while permitting relative turning therebetween.

3. A cosmetic applicator as defined in claim 1; said cap, tubular member and base portion being cylindrical and having substantially the same external diameter.

4. A cosmetic applicator as defined in claim 1; said extension portion and base portion providing stop means engageable with the forward and rearward ends, respectively, of said tubular member to prevent substantial relative longitudinal movement between said carrier sleeve structure and tubular member while permitting relative turning therebetween, said cap, tubular member and base portion being cylindrical and having substantially the same external diameter.

5. A cosmetic applicator as defined in claim 1; the forward end of said slot terminating at the rear end of said extension portion.

6. A cosmetic applicator as defined in claim 1; said carrier sleeve structure including a sleeve extending forwardly from said base portion and secured thereto, said base portion having a circumferential groove receiving the rear portion of said sleeve, said slot being provided in the sleeve of said carrier sleeve structure.

7. A cosmetic applicator as defined in claim 1; said carrier sleeve structure including a sleeve extending forwardly from said base portion and secured thereto, said base portion having a circumferential groove receiving the rear portion of said sleeve, said slot being provided in the sleeve of said carrier sleeve structure with its rear end opening through the rear end of said sleeve and its forward end terminating at the rear end of said extension portion.

8. A cosmetic applicator as defined in claim 1; said extension portion and base portion providing stop means engageable with the forward and rearward ends, respectively, of said tubular member to prevent substantial relative longitudinal movement between said carrier sleeve structure and tubular member while permitting relative turning therebetween, said carrier sleeve structure including a sleeve extending forwardly from said base portion and secured thereto, said base portion having a circumferential groove receiving the rear portion of said sleeve, said slot being provided in the sleeve of said carrier sleeve structure.

9. A cosmetic applicator as defined in claim 1; said extension portion and base portion providing stop means engageable with the forward and rearward ends, respectively, of said tubular member to prevent substantial relative longitudinal movement between said carrier sleeve structure and tubular member while permitting relative turning therebetween, said carrier sleeve structure including a sleeve extending forwardly from said base portion and secured thereto, said base portion having a circumferential groove receiving the rear portion of said sleeve, said slot being provided in the sleeve of said carrier sleeve structure, said cap, tubular member and base portion being cylindrical and having substantially the same external diameter.

10. A cosmetic applicator as defined in claim 1; said extension portion and base portion providing stop means engageable with the forward and rearward ends, respectively, of said tubular member to prevent substantial relative longitudinal movement between said carrier sleeve structure and tubular member while permitting relative turning therebetween, said carrier sleeve structure including a sleeve extending forwardly from said base portion and secured thereto, said base portion having a circumferential groove receiving the rear portion of said sleeve, said slot being provided in the sleeve of said carrier sleeve structure with its rear end opening through the rear end of said sleeve and its forward end terminating at the rear end of said extension portion.

11. A cosmetic applicator as defined in claim 1; said extension portion and base portion providing stop means engageable with the forward and rearward ends, respectively, of said tubular member to prevent substantial relative longitudinal movement between said carrier sleeve structure and tubular member while permitting relative turning therebetween, said carrier sleeve structure including a sleeve extending forwardly from said base portion and secured thereto, said base portion having a circumferential groove receiving the rear portion of said sleeve, said slot being provided in the sleeve of said carrier sleeve structure with its rear end opening through the rear end of said sleeve and its forward end terminating at the rear end of said extension portion, said cap, tubular member and base portion being cylindrical and having substantially the same external diameter.

* * * * *

UNITED STATES PATENT AND TRADEMARK OFFICE

CERTIFICATE OF CORRECTION

PATENT NO. : 3,991,775

DATED : November 16, 1976

INVENTOR(S) : WALTER B. SPATZ

It is certified that error appears in the above-identified patent and that said Letters Patent are hereby corrected as shown below:

Column 3, line 40, cancel "the", second occurrence;

line 49, change "cut" to -- cup --;

line 57, after "10" delete the period "."

and insert -- , --.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*